United States Patent [19]

McLean

[11] 4,328,670

[45] May 11, 1982

[54] HYDRAULIC MOTION AMPLIFIER

[75] Inventor: John R. McLean, Richmond, Va.

[73] Assignee: Reynolds Metals Company, Richmond, Va.

[21] Appl. No.: 192,011

[22] Filed: Sep. 29, 1980

[51] Int. Cl.[3] ..... F15B 7/02

[52] U.S. Cl. ..... 60/543; 60/573; 60/594

[58] Field of Search ..... 60/572, 583, 586, 594, 60/543, 546, 573

[56] References Cited

U.S. PATENT DOCUMENTS

| | | | |
|---|---|---|---|
| 2,551,274 | 5/1951 | MacDuff | 60/572 |
| 2,882,686 | 4/1959 | Griffith | 60/572 |
| 2,997,849 | 8/1961 | Shimanckas | 60/572 |
| 3,152,448 | 10/1964 | Mercier | 60/572 |
| 4,187,762 | 2/1980 | Buzby | 60/594 |

*Primary Examiner*—Abraham Hershkovitz

*Attorney, Agent, or Firm*—Lyne, Girard & McDonald

[57] ABSTRACT

A hydraulic system for motion amplification is disclosed. The system provides hydraulic fluid on both sides of a pair of hydraulic cylinders, creating a pressurized closed loop which provides precision control during both forward and reverse strokes of each hydraulic piston.

7 Claims, 1 Drawing Figure

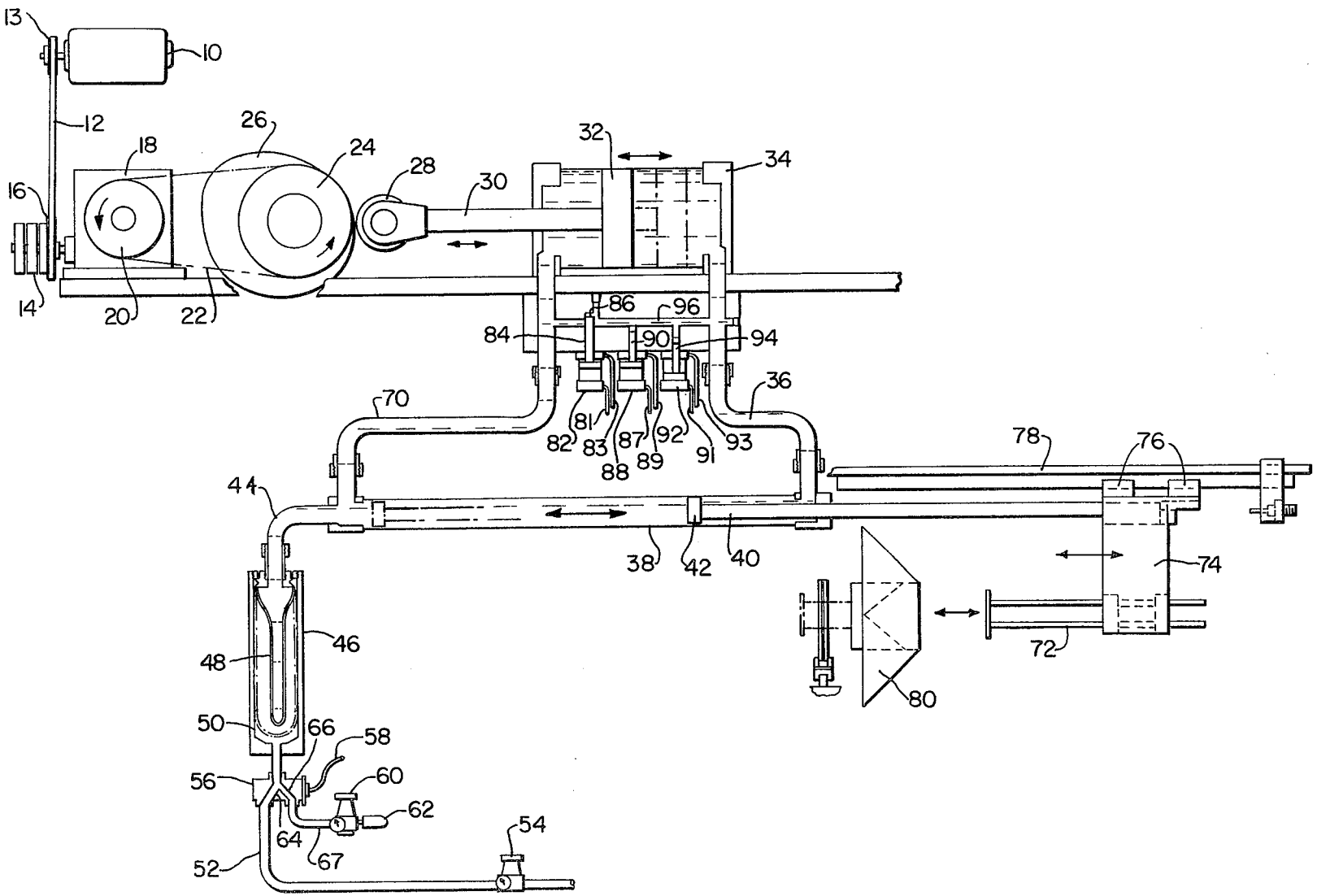
10
12
13
16
14
18
20
22
26
24
28
30
32
34
36
94
93
91
96
92
90
89
87
86
88
83
81
82
84
70
78
76
74
72
80
40
42
38
44
46
48
50
56
52
54
58
60
62
66
67
64

HYDRAULIC MOTION AMPLIFIER

BACKGROUND OF THE INVENTION

The amplification of pressure and/or motion through the use of hydraulic cylinders and pistons is known. In such systems, a pair of hydraulic cylinders are connected in fluid flow relation and pistons are chosen having differing piston surface areas, with the relative amount of motions of the pistons being inversely proportional to their areas, so that an equal volume of space is displaced by each piston.

In the past, such systems were one-way systems. By this, it is meant that hydraulic fluid was positioned only on one side of the pistons. Spring, pneumatic or other pressure was required to reverse the stroke of such systems.

It was found that consistently accurate motion of such systems was difficult. Small amounts of hydraulic fluid loss, such as losses between the pistons and cylinder walls during reversing strokes, lead to decreases in the amount of hydraulic fluid between the pistons, thus adversely affecting the precise location for the initial and final positionings of the two pistons. When hydraulic motion being amplified by such a system was employed for movement of external parts connected to one of the pistons, such changes in the initial and final stroke positions could cause inaccurate positioning of the mechanical parts linked to this piston, thus leading to possible improper placement of these parts.

A further problem exists in the employment of such one-way hydraulic systems. Due to the lack of any constraining force on the piston being advanced by the hydraulic fluid, its velocity is not retarded, even when the velocity of the driving piston and the hydraulic fluid is reduced. Thus, vacuum or air pockets can form in the hydraulic line and accurate control of the velocity of the hydraulically moved piston is not possible. Vacuum pockets in the hydraulic line produce the phenomenom known as cavitation.

THE PRESENT INVENTION

By means of the present invention, a hydraulic motion amplification system is disclosed which overcomes these problems. The hydraulic motion amplification system of the present invention includes a pair of hydraulic pistons and cylinders, with hydraulic fluid pressure being maintained on both sides of both pistons. The system also includes means for advancing the driving piston and means for controlling the pressure on the rear side of the driving piston and the front side of the driven piston, which means also provides the driving force for reversing the piston motion. Such a system prevents cavitation by maintaining a constant restraining pressure against the driven piston, thus assuring that its velocity will remain in the same ratio as that of the driving piston and the hydraulic fluid, and, additionally, compensates for any losses in the amount of hydraulic fluid within the closed loop, thus reducing positioning problems at each end of the strokes of the pistons caused by hydraulic fluid loss.

BRIEF DESCRIPTION OF THE DRAWING

The hydraulic motion amplification system of the present invention will be more fully described with reference to the drawing in which:

The FIGURE is a schematic representation of a hydraulic motion amplification system according to the present invention, illustrating the closed-looped hydraulic system.

DETAILED DESCRIPTION OF THE PREFERRED EMBODIMENT

Turning now to the FIGURE, a hydraulic motion amplification system, according to the present invention, is illustrated. The driving force for the system is provided by a motor 10 having a pulley 13 connected thereto. Pulley 13 drives belt or chain 12, which in turn drives pulley 16. A clutch brake 14 is provided to permit constant operation of the motor 10 independently from the hydraulic motion amplification system, so that the motor 10 may operation additional elements of a machine (not shown) in cooperation with the hydraulic motion system.

Pulley 16 is connected to a gear box 18, which gear box 18 may be designed to provide a suitable gear reduction ratio from the speed of the motor 10. Thus, the gear box 18 receives its driving force from the rotation of pulley 16 and translates this rotation, after gear reduction, to pulley 20. Pulley 20 is connected by chain or belt 22 to pulley 24, which pulley 24 has cam 26 mounted for rotation therewith. Cam 26 determines the length of and changes in velocity in the stroke of the driving piston 32. The cam 26 is mounted on a common shaft with pulley 24. The cam 26 is mounted to provide ease of replacement, so that changes in cam 26 to accommodate varying stroke patterns may be readily accomplished.

A cam follower 28 contacts cam 26 and translates the motion of cam 26 to piston 32 through piston rod 30. Piston 32 is enclosed within hydraulic cylinder 34. As the piston 32 is advanced, its front face forces hydraulic fluid out of the front end of cylinder 34 and through hydraulic line 36 into the rear end of a second hydraulic cylinder 38. This hydraulic fluid applies a force to the rear face of driven piston 42, advancing this piston 42. Piston 42 is connected to piston rod 40, which piston rod 40 is advanced with piston 42.

Piston rod 40 is connected to whatever mechanical element is to be driven by the hydraulic motion amplification system of the present invention. As illustrated, connected at the end of piston rod 40 opposite to that of piston 42 is a bracket 74. The bracket 74 carries pusher 72, which pusher 72 is then the element being controlled by the hydraulic motion amplification system as illustrated. Bracket 74 also includes a pair of followers 76 which move within a track 78 to guide its linear movement. Pusher 72 thus moves toward collar 80, forcing an article through collar 80. Of course, this is only one of numerous elements which could be activated by the hydraulic motion amplification system of the present invention, and is shown merely for illustrative purposes. The element being activated forms no part of the present invention.

As previously mentioned, the hydraulic motion amplification system of the present invention is a closed system. Thus, not only is there hydraulic fluid between the front face of the driving piston 32 and the rear face of the driven piston 42, there is hydraulic fluid between the front face of the driven piston 42 and the rear face of the driving piston 32. Thus, as driven piston 42 advances, hydraulic fluid is forced by its front face out of the front end of hydraulic cylinder 38 and in two separate directions. Part of this hydraulic fluid passes through hydraulic line 70 and into the rear end of hydraulic cylinder 34. Additionally, hydraulic fluid passes from hydraulic cylinder 38 through hydraulic line 44 and into pressure control means 46.

Pressure control means 46 maintains pressure on the front face of driven piston 42 and the rear face of driving piston 32 during advancing of these pistons. This pressure, especially acting against the front face of driven piston 42, maintains the velocity of driven piston 42 to that caused by the motion of piston 32, as determined by cam 26, preventing cavitation.

To accomplish this result, hydraulic fluid passing through line 44 enters a flexible bladder 48. This bladder 48 may be rubber or another flexible material. As the bladder expands, air, which was under pressure within a chamber 50 surrounding bladder 48, as will be described below, either increases the pressure of the hydraulic fluid between the front face of piston 42 and the rear face of piston 32 or must exit from the chamber 50 surrounding bladder 48. Air exits chamber 50 and enters a three-way valve 56. During this portion of the cycle, three-way valve 56 has received a signal through line 58 to permit air to escape through line 66 of valve 56 to exit line 67. At the end of line 67 is a pressure regulator 60. Thus, when air pressure within chamber 50 exceeds the pressure selected for regulator 60, pressure regulator 60 permits air to escape through exit muffler 62 to maintain the pressure of cylinder 50, and thus the pressure of the hydraulic fluid between the front face of driven piston 42 and the rear face of the driving piston 32, at the predetermined level.

At the end of the forward stroke, additional force must be applied to the front face of driven piston 42 to now force this piston 42 to reverse itself and thus now reverse driving piston 32 and maintain cam follower 28 in constant contact with cam 26. This additional force is again supplied by pressure controller 46. At the end of the forward strokes of pistons 32 and 42, a reversing signal is given through line 58 to three-way valve 56, closing line 66 and opening line 64 therein. Air under pressure is then forced into chamber 50 from line 52. This air pressure is controlled by pressure controller 54 at a predetermined level. The increased air pressure within chamber 50 squeezes upon bladder 48, forcing hydraulic fluid out of bladder 48 and through line 44. Due to the smaller surface area of the rear face of the driven piston 42 than its front face, the hydraulic fluid between the rear face of driven piston 42 and the front face of driving piston 32 sees an increased pressure, reversing the motion of piston 32 and maintaining cam follower 28 in contact with cam 26.

At the end of each cycle, it is important to assure that each element has, in fact, returned to its original position. Thus, air cylinder 82 retracts piston rod 84 momentarily. This is accomplished by means of a signal through line 83. This permits hydraulic fluid to flow through line 96 and throughout the system, thus adjusting for any hydraulic fluid which may have escaped from throughout the system and temporarily equalizing pressure throughout. Should piston 42 reverse farther than that predetermined, the hydraulic pressure will be somewhat greater between its rear face and the front face of piston 32. Thus, in order to equalize the pressure when line 96 is opened, piston 42 will advance slightly. Similarly, if piston 42 had not quite reversed completely, increased hydraulic pressure between its front face and the rear face of piston 32 will cause piston 42 to reverse slightly, in order to balance the pressures when line 96 is opened. A reversing signal is then given through line 81 to return to the normal, two-sided, closed system.

Air cylinder 82 serves an additional purpose. A fluid pressure is maintained above piston rod 84 by means of region 86 formed above piston 84 as a portion of line 96. Should the pressure between the front face of driving piston 32 and the rear face of driven piston 42 exceed a predetermined level, such as by driven element 72 being stalled or otherwise obstructed, the increased pressure will overcome the loading on piston 84 and permit escape of pressure to the opposite side of piston 32, thus stopping further motion of piston 42.

Adjustments in stroke length can be made by means of air cylinders 88 and 92. As shown, air cylinder 88 has its piston rod 90 in a normally extended position, while air cylinder 92 has its piston rod 94 in a normally retracted position. By providing appropriate air signals to air cylinder 88 through air lines 87 and 89 and/or to air cylinder 92 through air lines 91 and 93, additions or reductions to the volume to be filled by the hydraulic fluid between the front face of piston 32 and rear face of piston 42 can be made. Reductions in this volume, such as by extending piston rod 94 of cylinder 92, will set piston 42 in a slightly advanced state, while additions to the volume, such as by retracting piston 90 of cylinder 88 will retract piston 42 slightly. These adjustments provide for predetermined changes in alignment, as necessary for the elements being carried by piston rod 40.

As illustrated, motion amplification is made by providing a driving piston 32 having a large piston surface area and short stroke and a driven piston 42 having a small piston surface area and a long stroke. Clearly, however, these cylinders could be reversed, with a small area-long stroke driving piston driving a large area-short stroke driven piston. In this case, force amplification, rather than motion amplification, would result.

From the foregoing, it is clear that the present invention provides a hydraulic motion amplification system which prevents cavitation and provides accurate control over the mechanical parts being driven by the system.

While a presently preferred embodiment of the present invention has been illustrated and described, it is clear that the invention may be otherwise embodied and practiced within the scope of the following claims.

I claim:

1. A hydraulic motion amplification system comprising a first hydraulic cylinder having a piston and a piston rod, a second hydraulic cylinder having a piston and a piston rod, a motor driven cam and a cam follower contacting said cam, said cam follower being connected to said first piston rod for driving said first piston in a first direction, a first hydraulic line connecting the front end of said first hydraulic cylinder to the rear end of said second hydraulic cylinder, a second hydraulic line connecting the front end of said second hydraulic cylinder to the rear end of said first hydraulic cylinder, hydraulic fluid on both ends of both hydraulic cylinders, a flexible bladder hydraulically connected to said second hydraulic line, an air chamber surrounding said bladder and means for controlling air pressure within said air chamber for controlling hydraulic pressure between the front face of said second piston and the rear face of said first piston and for driving said first piston in a second direction, and a third hydraulic line connecting said first and said second hydraulic lines and an air cylinder for opening and closing said third hydraulic line for balancing hydraulic pressure on both ends of both hydraulic cylinders after each cycle of said system, said pistons having differing surface areas to produce a ratio of movement between said pistons.

2. The system of claim 1 wherein said means for controlling air pressure within said air chamber comprises a pressurized air supply line having a pressure regulator thereon, an air exhaust line having a pressure regulator thereon and a switchable valve means connecting said air supply line and said air exhaust line to said air chamber.

3. The system of claim 1 including means for adjusting the initial position of said second piston.

4. The system of claim 3 wherein said means for adjusting comprises at least one air cylinder hydraulically connected to said third hydraulic line to increase or decrease the volume between the front face of said first piston and the rear face of said second piston.

5. The system of claim 1 wherein said first piston has a larger surface area and shorter stroke and said second piston has a smaller surface area and a longer stroke.

6. The system of claim 5 further comprising means connected to and carried for linear movement by said second piston rod.

7. The system of claim 1 wherein said first piston has a smaller surface area and a longer stroke and said second piston has a larger surface area and a shorter stroke.

* * * * *